US010216113B2

(12) United States Patent
Kim et al.

(10) Patent No.: US 10,216,113 B2
(45) Date of Patent: Feb. 26, 2019

(54) ROLLER FOR IMAGE FORMING APPARATUS

(71) Applicant: S-PRINTING SOLUTION CO., LTD., Suwon-si (KR)

(72) Inventors: Tae-hyun Kim, Hwaseong-si (KR); Norihiro Harada, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 246 days.

(21) Appl. No.: 15/070,623

(22) Filed: Mar. 15, 2016

(65) Prior Publication Data

US 2017/0060016 A1 Mar. 2, 2017

(30) Foreign Application Priority Data

Aug. 26, 2015 (KR) ..... 10-2015-0120441

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS

| | | | | |
|---|---|---|---|---|
| 2004/0265006 | A1* | 12/2004 | Taniguchi | G03G 15/0233 399/174 |
| 2008/0219713 | A1* | 9/2008 | Gopalanarayanan | G03G 15/0818 399/286 |
| 2012/0076539 | A1* | 3/2012 | Sato | G03G 15/0233 399/174 |
| 2014/0234764 | A1* | 8/2014 | Aoyama | G03G 15/0233 430/56 |
| 2015/0041735 | A1* | 2/2015 | Wang | G02F 1/133514 252/586 |

FOREIGN PATENT DOCUMENTS

| | | |
|---|---|---|
| JP | 2000-330373 | 11/2000 |
| JP | 2004-157382 | 6/2004 |
| JP | 2006-78636 | 3/2006 |
| JP | 2007-131770 | 5/2007 |
| JP | 2007-133223 | 5/2007 |
| JP | 2007-133224 | 5/2007 |
| JP | 4194263 | 10/2008 |
| JP | 2009-109861 | 5/2009 |
| JP | 5204951 | 2/2013 |

* cited by examiner

*Primary Examiner* — Sheeba Ahmed
(74) *Attorney, Agent, or Firm* — Staas & Halsey LLP

(57) ABSTRACT

A roller for an image forming apparatus is provided. The roller includes a shaft rotatable on the basis of one axis, an elastic layer covering an outer circumference of the shaft, and a coating layer formed on the elastic layer. The coating layer is a material in which a mixture containing acryl polyol and ε-caprolactone polyol is cross-linked by isocyanate.

20 Claims, 2 Drawing Sheets

ROLLER FOR IMAGE FORMING APPARATUS

CROSS-REFERENCE TO RELATED APPLICATIONS

This application claims priority from Korean Patent Application No. 10-2015-0120441, filed on Aug. 26, 2015, in the Korean Intellectual Property Office, the disclosure of which is incorporated herein by reference in its entirety.

BACKGROUND

1. Field

Apparatuses and methods consistent with exemplary embodiments relate to a roller used in an image forming apparatus, and more particularly, to a roller including a coating layer for improved durability.

2. Related Art

In general, electrophotographic image forming apparatuses such as a laser printer, a facsimile, or a copy machine may include photoreceptor, and a charging roller, a developing roller, and a transfer roller which are installed in a circumference of the photoreceptor, and the like. A developing agent supplied from a developing device may move by voltages applied to the photoreceptor, the charging roller, the developing roller, and the transfer roller, and thus a certain image may be formed in a printing medium.

For example, the charging roller may charge a surface of the photoreceptor to a certain voltage, and light scanned from the exposure unit may form an electrostatic latent image corresponding to printing data on the charged surface of the photoreceptor. The developing roller may supply the developing agent to the photoreceptor so that the electrostatic latent image may be developed to an image by the developing agent. The image by the developing agent may be transferred onto the printing medium passing between the photoreceptor and the transfer roller through the transfer roller.

The developing roller and the charging roller may be core parts which move and charge a toner as described above, and precise parts which have characteristics such as low surface roughness, a low surface fiction coefficient, uniform electrical conductivity, high elasticity, and low hardness.

In high-end laser printers, since the number of developing sheets which is twice more than that in low-end printers is needed, the durability of the developing roller and the charging roller is further important. Accordingly, there is a need for surface coating technology development for maintaining characteristics required in the developing roller and the charging roller and improving the durability of the surfaces thereof.

SUMMARY

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a roller for an image forming apparatus including a coating layer for durability improvement.

According to an aspect of an exemplary embodiment, there is provided a roller for an image forming apparatus including a shaft rotatable on the basis of one axis; an elastic layer covering an outer circumference of the shaft; and a coating layer formed on the elastic layer. The coating layer may be a material in which a mixture containing acryl polyol and ε-caprolactone polyol is cross-linked by isocyanate.

A weight ratio of the acryl polyol to the ε-caprolactone polyol may be 90:10 to 10 to 90.

The acryl polyol may be ε-caprolactone-modified hydroxy acrylate.

The ε-caprolactone-modified hydroxy acrylate may be selected from the group consisting of hydroxyethyl methacrylate, hydroxyethyl acrylate, and a compound represented with the following formula 1.

[Formula 1]

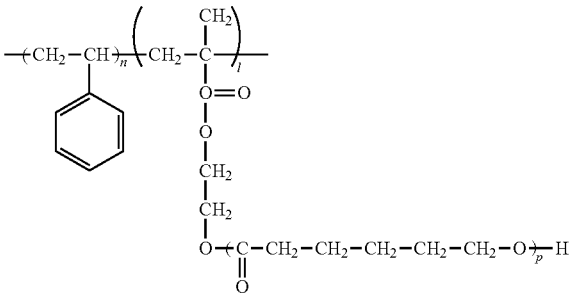

The ε-caprolactone polyol may be selected from the group consisting of polycaprolactone diol, polycaprolactone triol, and polycaprolactone tetraol.

The coating layer may further contain a conductive agent and a dispersing agent.

The conductive agent may be carbon black, and the dispersing agent may be methyloxirane polymer with oxirane, mono (diethylamino) alkyl ether.

According to an aspect of an exemplary embodiment, there is provided an image forming apparatus including a photoreceptor in which an electrostatic latent image is formed; a developing roller configured to supply a toner to a photoreceptor, and a charging roller configured to charge the photoreceptor. At least one of the developing roller and the charging roller may be the roller for an image forming apparatus according to any one among the above-described various exemplary embodiments.

Additional aspects and advantages of the exemplary embodiments are set forth in the detailed description, and will be obvious from the detailed description, or may be learned by practicing the exemplary embodiments.

BRIEF DESCRIPTION OF THE DRAWINGS

The above and/or other aspects of the present disclosure will be more apparent by describing certain exemplary embodiments of the present disclosure with reference to the accompanying drawings, in which.

DESCRIPTION OF EMBODIMENTS

Figure 1:
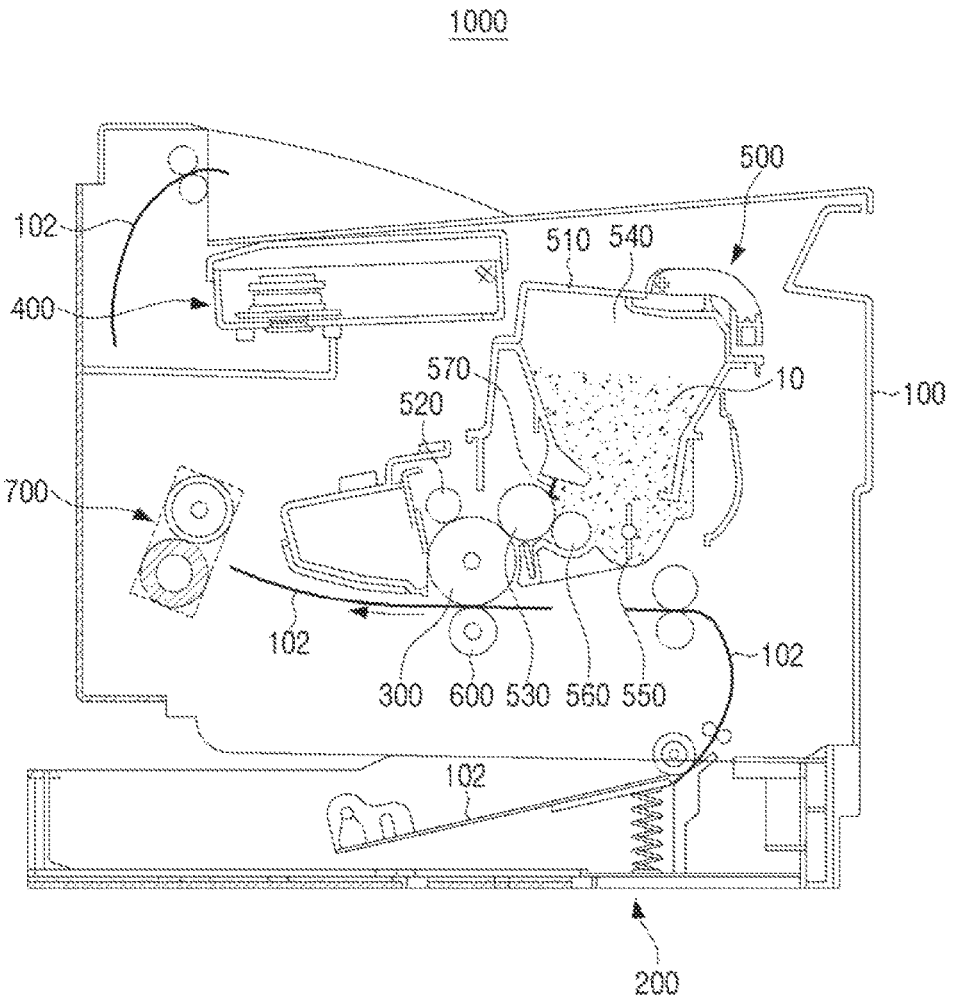
FIG. 1 is a diagram illustrating an internal configuration of an image forming apparatus according to an exemplary embodiment.

Hereinafter, the exemplary embodiments are described in greater detail with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

The exemplary embodiments may vary and may be provided in different exemplary embodiments. Specific exemplary embodiments will be described with reference to accompanying drawings and detailed explanation. However, this does not necessarily limit the scope of the exemplary embodiments to a specific embodiment form. Instead, modifications, equivalents and replacements included in the disclosed concept and technical scope of this specification may be employed. While describing exemplary embodiments, if it is determined that the specific description regarding a known technology obscures the gist of the disclosure, the specific description is omitted.

FIG. 1 is a diagram illustrating an image forming apparatus in which a roller for an image forming apparatus according to an exemplary embodiment is useable.

Referring to FIG. 1, an image forming apparatus 1000 according to an exemplary embodiment may include a main body case 100, a paper supply unit 200, a photoreceptor 300, a light scanning unit 400, a developing cartridge 500, a transfer roller 600, and a fixing unit 700.

The main body case 100 may form an outer appearance of the image forming apparatus 1000. The paper supply unit 200 may be provided in the inside of the main body case 100, and paper 102 may be loaded in the paper supply unit 200.

The photoreceptor 300 may have a columnar drum shape extending to a certain length to correspond to a width of the paper 102. The photoreceptor 300 may be charged with a potential having a fixed polarity through the charging roller 520. An electrostatic latent image due to a potential difference may be formed in the photoreceptor 300 of which an outer circumference is uniformly charged through a beam scanned from the light scanning unit 400. A toner 10 may be supplied to the electrostatic latent image through the developing roller 530, and an image by the toner 10 may be transferred onto the paper 102 passing between the photoreceptor 300 and the transfer roller 600.

The light scanning unit 400 may allow the electrostatic latent image to be formed in the photoreceptor 300 by scanning the beam corresponding to image data to be formed on the paper 102 to the photoreceptor 300. The light scanning unit 400 may include a laser scanning unit using a laser diode as a light source, and the laser scanning unit may be replaced with other various types of light sources.

The developing cartridge 500 may supply the toner 10 as a developing agent to the electrostatic latent image of the photoreceptor 300. The developing cartridge 500 may include a cartridge case 510, the charging roller 520, the developing roller 530, a toner storage unit 540, a hopper 550, a feed roller 560, and a regulating blade 570.

The charging roller 520 may rotate to be in contact with the photoreceptor 300 and charge the surface of the photoreceptor 300 with a uniform potential value. The developing roller 530 may supply the toner 10 to the electrostatic latent image formed in the photoreceptor 300. The toner storage unit 540 may be formed in the inside of the cartridge case 510 and the toner 10 may be stored in the toner storage unit 540. The hopper 550 may be provided in the toner storage unit 540. The feed roller 560 may be provided in the toner storage unit 540 and supply the toner 10 to the developing roller 530. The regulating blade 570 may extend from the toner storage unit 540 to be in contact with the developing roller 530. The charging roller 520 may be provided in the inside of the cartridge case 510 and rotate to be in contact with the photoreceptor 300. A charging bias is applied to the charging roller 520, and the charging roller 520 may charge the outer circumference of the photoreceptor 300 with an equal potential value. In response to the beam from the light scanning unit 400 being scanned to the photoreceptor 300 charged with the equal potential value through the charging roller 520, the potential value in a point to which the beam is scanned may be changed due to a photoconductive characteristic of the photoreceptor 300. Accordingly, the potential difference between the beam-scanned point and a non-beam-scanned point of the photoreceptor 300 may be generated, and thus the electrostatic latent image due to the potential difference may be formed in the photoreceptor 300. The developing roller 530 may be installed close to the toner storage unit 540 and rotate to an opposite direction to a rotation direction of the photoreceptor 300. The developing roller 530 to which a developing bias is applied may rotate to be in contact with the feed roller 560, and the toner 10 from the feed roller 560 may be attached to the developing roller 530 by the potential difference from the feed roller 560. The developing roller 530 to which the toner 10 is attached may rotate to be in contact with the photoreceptor 530 and allow the attached toner 10 to be supplied as the electrostatic latent image of the photoreceptor 300. The toner storage unit 540 may be formed in the inside of the cartridge case 510 as a containing space for storing the toner 10. Since one side of the toner storage unit 540 in which the developing roller 530 is provided is opened, the stored toner 10 may be supplied to the developing roller 530 through the feed roller 560. At least one hopper 550 may be installed in the toner storage unit 540. The hopper 550 may rotate in the toner storage unit 540 to move the toner 10 toward the feed roller 560, and the hopper 550 may prevent the solidification of the toner 10 and improve fluidity of the toner 10 by agitating the toner 10. The hopper 550 may allow the toner 10 to be charged with a certain potential value by agitating the toner 10. The feed roller 560 may be provided in a lower side of the toner storage unit 540 and may rotate to be in contact with the developing roller 530. The feed roller 560 and the developing roller 530 are rotated toward each other, i.e. in opposite directions. As such, the toner 10, which receives friction while passing between the feed roller 560 and the developing roller 530, is charged to a constant potential energy and simultaneously, attached to the developer roller 530 in an appropriate amount The regulating blade 570 may be in contact with the developing roller 530 with certain applied pressure. Accordingly, the regulating blade 570 may ensure the uniformity in the amount of toner 10 supplied from the feed roller 560 and adhered to the developing roller 530, that is, the uniformity in a weight ($M/A$ [$g/cm^2$]) of the toner 10 per unit area of the developing roller 530. The regulating blade 570 may charge the toner 10 adhered to the developing roller 530 with a certain potential value. To the end, the regulating blade 570 may contain a conductive material and may be provided to have a fixed potential value by receiving power.

The transfer roller 600 may rotate to be in contact with the photoreceptor 300 and allow the image by the toner 10 to be transferred onto the paper 102. The fixing unit 700 may fix the image by the toner 10 onto the paper 102.

A roller in an exemplary embodiment may be used as the charging roller 520 or the developing roller 530 of the image forming apparatus 1000. Hereinafter, the charging roller 520 and the developing roller 530 of the image forming apparatus 1000 may collectively refer to a "roller".

Figure 2:
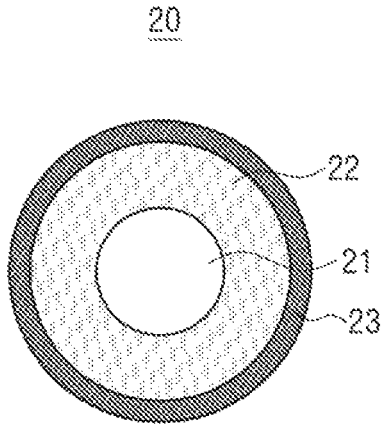
FIG. 2 is a cross-sectional view illustrating a roller for an image forming apparatus according to an exemplary embodiment.

FIG. 2 is a diagram illustrating a roller according to an exemplary embodiment.

Referring to FIG. 2, the roller 20 may include a shaft 21 located in a center thereof, an elastic layer 22 surrounding the shaft, and a coating layer 23 formed on the elastic layer.

A material for the shaft 21 may include any conductive material. For example, the shaft 21 may be formed of a metal such as aluminum, iron, or stainless steel, and may have a cylindrical shape having an outer diameter of 4 mm to 20 mm.

The elastic layer 22 may be formed on an outer circumference of the shaft 21. For example, the elastic layer 22 may contain polyurethane, natural rubber, butyl rubber, nitrile rubber, polyisoprene rubber, polybutadiene rubber, silicon rubber, styrene-butadiene rubber, ethylene-propylene rubber, ethylene-propylene-diene rubber, chloroprene rubber, acrylic rubber, or the like or a combination thereof.

The silicon rubber, urethane, or ethylene propylene diene monomer (EPDM) being used as the elastic layer 22, the elastic layer 22 may allow the developing roller to have low hardness and simultaneously to have improved abrasion resistance. Accordingly, deterioration in image quality due to degradation of the abrasion resistance according to a long usage time or toner leakage due to abrasion of a toner sealing part in both ends of the roller may be prevented. For example, when the silicon rubber is used in a conductive resin layer, a substrate material may contain methylphenyl silicon rubber, fluorine-modified silicon rubber, polyether-modified silicon rubber, or alcohol-modified silicon rubber. In this example, the arbitrary substrate material may be separately used. In some examples, at least two substrate materials may be combined and used.

When a material having high hardness such as nitrile rubber, styrene-butadiene rubber, ethylene-propylene rubber, or ethylene-propylene-diene rubber is used as the elastic layer 22, processing may be made easy, and thus the material may be advantageous when precise dimensions, such as of an outer diameter or runout, are required.

If the roller 20 is the developing roller which supplies the toner onto the photoreceptor, the roller 20 may be disposed to be in contact with the photoreceptor (contact developing method) or may be disposed to be spaced from the photoreceptor (non-contact developing method).

If the roller 20 is the charging roller which electrically charges the photoreceptor, the roller 20 may be disposed in the image forming apparatus 1000 to be in contact with the photoreceptor.

The elastic layer 22 may have a hardness of 25° to 45° as an Asker-A type in mono-component contact developing method, and a hardness of 40° to 65° as an Asker-A type in mono-component non-contact developing method. Since the hardness can be determined according to speed, lifespan, cost, and the like of a printer, the hardness need not be fixed according to the developing method.

The elastic layer 22 may have a thickness, for example, in a range of 0.5 mm to 8.0 mm. In the thickness of the above-described range, the roller 20 may appear good in elasticity, restoration for deformation of a substrate material of the roller may be ensured, and stress for the toner may be reduced. The thickness of the elastic layer 22 may be, for example, in a range of 0.5 mm to 2.0 mm in the one-ingredient non-contact developing method, and the thickness of the elastic layer 22 may be, for example, in a range of 1.5 mm to 8.0 mm in the one-ingredient contact developing method.

The coating layer 23 may be formed to cover the elastic layer 22.

For example, the coating layer 23 may contain a urethane resin formed by cross-linking a mixture containing acryl polyol and ε-caprolactone polyol by a curing agent.

The acryl polyol used as a material for the coating layer 23 may be ε-caprolactone-modified hydroxy acrylate selected from the group consisting of hydroxyethyl methacrylate (HEMA) and hydroxyethyl acrylate (HEA).

According to an exemplary embodiment, the acryl polyol may be selected from epsilon-caprolactone-modified hydroxyalkyl (meth) acrylate formed as follows.

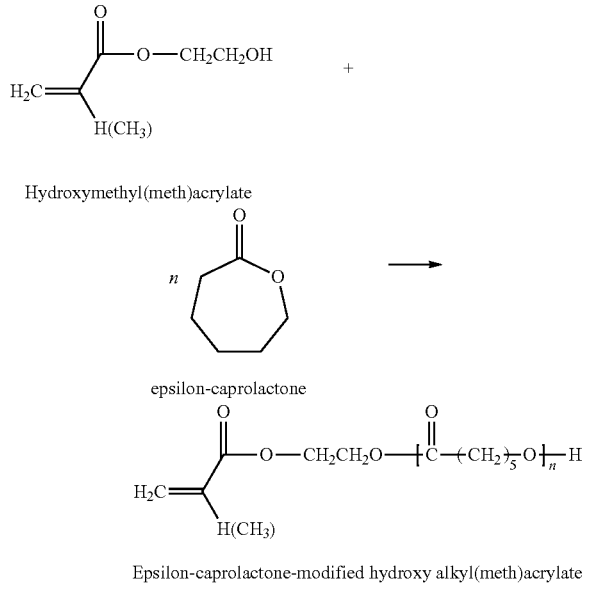

The glass transition temperature in the ε-caprolactone-modified hydroxy acrylate may be lowered as the number of caprolactone addition moles is increased. The commercially available ε-caprolactone-modified hydroxy acrylate may be PLACCEL FA series (acrylate derivatives) and PLACCEL FM series (methacrylate derivatives) which are sold by a DAICEL company. For example, according to the number n of caprolactone addition moles, the commercially available ε-caprolactone-modified hydroxy acrylate may be PLACCEL FA1 (n=1, $T_g$ of Homopolymer: −28° C.), PLACCEL FA2 (n=2, $T_g$ of Homopolymer: −40° C.), PLACCEL FA3 (n=3, $T_g$ of Homopolymer: −46° C.), PLACCEL FA4 (n=4, $T_g$ of Homopolymer: −51° C.), PLACCEL FA5 (n=5, $T_g$ of Homopolymer: −53° C.), PLACCEL FM1 (n=1, $T_g$ of Homopolymer: −8° C.), PLACCEL FM2 (n=2, $T_g$ of Homopolymer: −28° C.), PLACCEL FM3 (n=3, $T_g$ of Homopolymer: −37° C.), PLACCEL FM4 (n=4, $T_g$ of Homopolymer: −43° C.), PLACCEL FM 5 (n=5, $T_g$ of Homopolymer: −47° C.), or the like.

The ε-caprolactone-modified hydroxy acrylate may be selected from ε-caprolactone-modified hydroxy acrylate represented with the following formula 1. The commercially available product may be DC2016 (80 hydroxyl groups) or DC2009 (90 hydroxyl groups) of a DAICEL company.

[Formula 1]

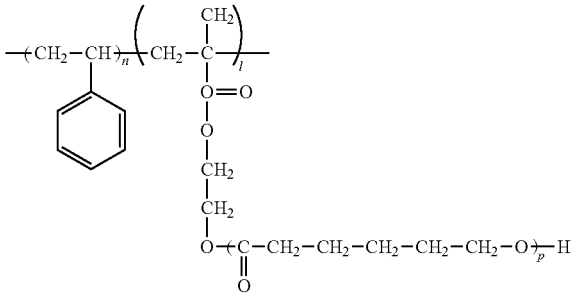

The ε-caprolactone polyol used as a material for the coating layer 23 may be selected from the group consisting of polycaprolactone diol, polycaprolactone triol, and polycaprolactone tetraol which may be formed as follows.

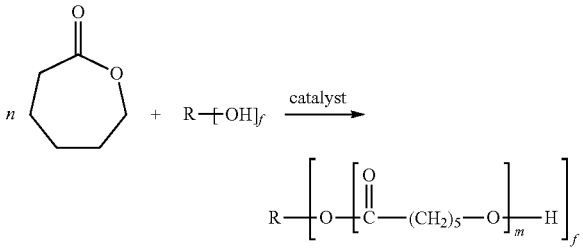

n = m *f
f: Number of functional group
(f = 2:diol, f = 3:triol, f = 4:tetraol)

As the ε-caprolactone polyol, PLACCEL 240, PLACCEL 230, PLACCEL 220, PLACCEL 212, PLACCEL 210, PLACCEL 208, PLACCEL 205, PLACCEL 230N, PLACCEL 220N, PLACCEL 210N, PLACCEL 220CPB, PLACCEL 2200PT, PLACCEL 2100P, PLACCEL L220AL, PLACCEL L212AL, PLACCEL 205U, PLACCEL 220EB, PLACCEL 220EC, PLACCEL T2203, PLACCEL T2205, PLACCEL T2207, PLACCEL 320, PLACCEL 312, PLACCEL 308, PLACCEL 305, PLACCEL 303, PLACCEL L320AL, and PLACCEL 410 which are commercially available and are sold by a DAICEL company, may be used.

The ε-caprolactone polyol may be polycaprolactone diol selected from compounds represented by $H[O(CH_2)_5CO]_nO—R—O[O(CH_2)_5CO]_mH$.

For example, the ε-caprolactone polyol may be selected from an acryl-free material to have low hardness.

The ε-caprolactone polyol may be selected from a material of which the number average molecular weight is in a range of 300 to 2000.

The curing agent for cross-linking the acryl polyol with ε-caprolactone polyol may be selected from an isocyanate ingredient.

As the isocyanate ingredient, thrylene diisocyanate (TDI), 4,4'-methylene diphenyl diisocyanate (MDI), polymeric MDI, modified MDI, 1,5-naphthalene diisocyanate, tolidine diisocyanate, hexamethylene diisocyanate (HDI), isophorone diisocyanate, p-phenylene diisocyanate, transcyclohexane-1,4-diisocyanate, xylene diisocyanate (XDI), hydrogenated XDI, hydrogenated MDI, lysine diisocyanate, triphenylmethane triisocyanate, tris(isocyanate phenyl)thio phosphate, tetramethyl xylene diisocyanate, lysine ester triisocyanate, 1,6,11-undecane triisocyanate, 1,8-diisocyanate-4-isocyanatemethyl octane, 1,3,6-hexamethylene triisocyanate, bicyclo heptane triisocyanate, trimethylhexamethylene diisocyanate, and blocked isocyanate having a structure which masks isocyanate as a blocking agent may be used. The blocked isocyanate may not react at room temperature and as a result of the blocked isocyanate being heated up to a temperature in which the blocking agent is dissociated, an isocyanate group may be regenerated. One kind or two or more kinds of them may be combined and used.

A catalyst may be contained in the coating layer 23 formed of the urethane resin cross-linked as described above according to the need. The catalyst may be triethylamine, N,N,N',N'-tetramethylethylenediamine, N,N,N',N",N"-pentamethyldiethylenetriamine, triethylenediamine, dimethylaminoethanol, bis(2-methylaminoethyl)ether, or the like. The catalyst may be used in a range of 0.05 weight part or more and 5 weight parts or less with respect to total 100 weight parts of a polyol ingredient and an isocyanate ingredient.

Beads for controlling roughness may be contained in the coating layer 23. The beads may maintain appropriate strength of the coating layer, control the surface roughness, and affect electrification of the toner according to the charging characteristic.

For example, as the beads, an acryl-based resin such as polyacrylate or polymethacrylate, a polyamide-based resin such as nylon, a polyolefin-based resin such as polyethylene or polypropylene, a silicon-based resin, a phenol-based resin, a polyurethane-based resin, a styrene-based resin, benzoguanamine, a polyfluorovinylidene-based resin, silica, metal oxide powder such as alumina, titanium oxide, or iron oxide, boron nitride, silicon carbide, and the like may be used. The beads may have a certain shape such as a spherical shape or a plate shape, or the beads may have an atypical structure. When a polymer resin is used for the beads, the beads may have a cross-linked form. The surface roughness of the coating layer 23 may be adjusted to a desired range by adjusting a diameter or content of the beads and a thickness of the coating layer. For example, an average size of the beads may be in a range of 3 to 30 μm.

An interval Rsm between the beads in the coating layer 23 may be 50 to 1000 μm and gloss (60 degrees) may be in a range of 0.1 to 15. If the interval between the beads is equal to or less than 50 μm, tendency to reset may be lacking, and if interval between the beads is equal to or larger than 1000 μm, an issue on the image concentration due to lowering of the toner layer may be caused. If the gloss is equal to or less than 0.1, tendency to reset may be lacking, and if the gloss is equal to or larger than 15, an issue on the image concentration due to lowering of the toner layer may be caused.

The coating layer may include a filler. For example, silica may be used as the filler. In another example, wet silica may be used as the filler.

A conductive agent for giving ions and electrical conductivity may be contained in the coating layer 23.

The conductive agent may be used to adjust the resistivity in a stable range of $10^2$ to $10^{10}$ Ωcm, preferably, in a range of $10^3$ to $10^6$ Ωcm.

The conductive agent to be usable may include at least one selected from the group consisting of a cationic surfactant such as lauryl trimethyl ammonium, stearyl trimethyl ammonium, octdodecyl trimethyl ammonium, dodecyl trimethyl ammonium, hexadecyl trimethyl ammonium, or modified fatty acid dimethyl ethyl ammonium; an anionic surfactant such as aliphatic sulfonate, higher alcohol sulfuric acid ester salt, higher alcohol ethylene oxide adduct sulfuric acid ester salt, and higher alcohol phosphoric acid ester salt, or higher alcohol ethylene oxide adduct phosphoric acid ester salt; conductive carbon black; a metal oxide such as tin oxide, titanium oxide, lithium oxide, or zinc oxide; a metal such as nickel, copper, lithium, silver, or germanium; a metallic salt such as $LiCF_3SO_3$, $NaClO_4$, $LiAsF_6$, $LiBF_4$, NaSCN, KSCN, or NaCl; and a conductive polymer such as polyaniline, polypyrrole, or polyacetal, or a combination thereof.

As the conductive agent, an inorganic ionic conductive material such as sodium perchlorate, lithium perchlorate, calcium perchlorate, or lithium chloride may be used. As the conductive agent, an organic ionic conductive material such as modified aliphatic dimethyl aluminum isosulfate or stearyl ammonium acetate may be used.

When the conductive carbon black is used as the conductive agent, Ketjenblack EC, acetylene black, carbon for rubber, oxidation-treated ink carbon, thermal decomposition carbon, and the like may be used. For example, the carbon black for rubber may include super abrasion furnace (SAF) carbon black, intermediate super abrasion furnace (ISAF) carbon black, high abrasion furnace (HAF) carbon black, fast extruding furnace (FEF) carbon black, general purpose furnace (GPF) carbon black, semi reinforcing furnace (SRF) carbon black, fine thermal (FT) carbon black, medium thermal (MT) carbon black, and the like.

As the conductive agent, graphite such as natural graphite or artificial graphite may be used.

Since the conductivity is easily controlled by a small amount of the carbon black, the carbon black may be used for the conductive agent. The carbon black as the conductive agent may be acidic carbon black having a pH of 2 to 4.

The conductive agent may be mixed with 1 to 50 weight parts or 0.5 to 30 weight parts with respect to 100 weight parts of the resin ingredient, that is, acryl polyol and ε-caprolactone polyol. When the conductive agent is carbon black, the conductive agent may be mixed with 1 to 40 weight parts with respect to 100 weight parts of the resin ingredient, that is, acryl polyol and ε-caprolactone polyol.

The coating layer 23 may contain a dispersing agent. The dispersing agent may serve to prevent the conductive agent such as carbon black from being agglomerated.

The dispersing agent may be methyloxirane polymer with oxirane, mono (diethylamino)alkyl ether (CAS No. 68511-96-6).

According to an exemplary embodiment, the dispersing agent may be contained with 2 to 11 weight parts with respect to 100 weight parts of the resin ingredient, that is, acryl polyol and ε-caprolactone polyol.

For example, the dispersing agent may be mixed with 5 to 30% of the total weight of the filler such as silica and the conductive agent such as carbon black. Accordingly, a stable resistance may be ensured through prevention of sedimentation or agglomeration of the conductive agent such as the carbon black.

According to an exemplary embodiment, the acryl polyol may be selected from a high hardness material having a glass transition temperature ($T_g$) of 0° C. to 20° C., and the ε-caprolactone polyol may be selected from a low hardness material which an acryl ingredient is not contained therein and has a glass transition temperature ($T_g$) of −40° C. or less. In response to the coating layer 23 being formed by cross-linking materials having different hardness characteristics, the demerits in the roller 20 having very low hardness, for example, filming that a partial toner is not developed and remains in the developing roller, and the demerits in the roller 20 having very high hardness, for example, the leakage of the toner due to the abrasion of the roller may be mutually supplemented.

The coating layer 23 may be applied regardless of the hardness of the elastic layer 22.

The acryl polyol having the relatively high hardness and the ε-caprolactone polyol having the relatively low hardness may be mixed at a ratio of 90:10 to 10 to 90.

The coating layer 23 may have a thickness in a range of 0.1 μm to 100 μm or in a range of 0.5 μm to 50 μm. The resistivity of the coating layer 23 may be controlled in a range of $10^5$ to $10^{11}$ Ωcm, preferably, in a range of $10^7$ to $10^{10}$ Ωcm. The roller 20 may have a surface roughness Rz that is typically controlled in a range of 1 μm to 40 μm, preferably, in a range of 3 μm to 25 μm.

Hereinafter, the roller, for example, the developing roller and the charging roller according to various examples will be described in detail using exemplary embodiments. However, the inventive concept is not limited to the following examples. Hereinafter, the following "comparative examples" may be presented to highlight specific configuration or characteristics of the inventive concept, and the comparative examples may be not understood as the conventional art or the background art but may be understood as the specific disclosure of the inventive concept like "examples".

In the following examples and comparative examples, the image concentration may be evaluated by calculating an average concentration value at predetermined five patches with respective to each of yellow (Y), magenta (M), cyan (C), and black (K) colors in an image printed with a predefined pattern.

After the image evaluation up to the lifespan is completed, the contamination degree of the filming (surface contamination of developing roller) is confirmed by taping the surface of the developing roller with the 3M measurement tape and observing with naked eyes an amount of the toner smeared to the measurement tape after detaching the measurement tape from the developing roller.

The durability is measured through a vertical white line represented in an image by the toner deteriorated by toner stress and adhered to a doctor blade.

TABLE 1

| | | Developing roller | | | | | | | |
|---|---|---|---|---|---|---|---|---|---|
| | | Example 1 | Example 2 | Example 3 | Example 4 | Comparative Example 1 | Comparative Example 2 | Comparative Example 3 | Comparative Example 4 |
| elastic layer | material | silicon | silicon | hydrin | hydrin | silicon | silicon | hydrin | hydrin |
| Coating layer | ε-caprolactone-modified hydroxy acrylate | 30 | 10 | 70 | 90 | 0 | 100 | 0 | 100 |
| | ε-caprolactone polyol | 70 | 90 | 30 | 10 | 100 | 0 | 100 | 0 |
| | Hexamethylene diisocyanate (HDI) | 73 | 73 | 73 | 73 | 73 | 73 | 73 | 73 |

TABLE 1-continued

| Developing roller | | | | | | | | | |
|---|---|---|---|---|---|---|---|---|---|
| | | Example 1 | Example 2 | Example 3 | Example 4 | Comparative Example 1 | Comparative Example 2 | Comparative Example 3 | Comparative Example 4 |
| | Dispersing agent methyloxirane polymer with oxirane, mono (diethylamino) alkyl ether | 5 | 5 | 5 | 5 | 5 | 5 | 5 | 5 |
| | MA-100 carbon black | 7 | 7 | 7 | 7 | 7 | 7 | 7 | 7 |
| | silica | 30 | 30 | 30 | 30 | 30 | 30 | 30 | 30 |
| Property value of developing roller | Surface hardness (IRHD) | 40 | 30 | 55 | 60 | 35 | 55 | 50 | 65 |
| | Hardness of elastic layer(Asker A) | 38 | 38 | 50 | 50 | 38 | 38 | 50 | 50 |
| | Gloss | 2.9 | 2.8 | 3.0 | 3.0 | 2.9 | 3.4 | 2.9 | 3.4 |
| | Resistance (200 V) | 1.0E+05 | 1.0E+05 | 1.0E+05 | 1.0E+05 | 1.0E+05 | 1.0E+05 | 1.0E+05 | 1.0E+05 |
| | Roughness Rz | 10 | 10 | 10 | 10 | 10 | 10 | 10 | 10 |
| | Surface crack | ◎ | ◎ | ◎ | ◎ | ◎ | X | X | Δ |
| Image quality | Image concentration | ◎ | ◎ | ◎ | ◎ | ◎ | ◎ | ◎ | ◎ |
| | Leak (aperiodic horizontal line) | ◎ | ◎ | ◎ | ◎ | ◎ | ◎ | ◎ | ◎ |
| | Contamination of non-image region | ○ | Δ | ◎ | ◎ | X | ○ | X | ◎ |
| | Filming (surface contamination of developing roller) | ◎ | ◎ | ○ | ○ | Δ | X | X | X |
| | Durability (vertical white line) (in 100K evaluation) | ◎ | ◎ | ○ | ○ | Δ | X | X | X |

◎: very good
○: good
Δ: acceptable
X: no good

The numerical values in Table 1 for the rows for "coating layer" indicate the respective weight part of each component relative to other listed components.

Developing Roller Comparative Example 1

It can be seen that due to the coating layer being formed by forming a urethane resin only using caprolactone polyol having a low glass transition temperature $T_g$ on the elastic layer formed of a silicon material having low hardness, the developing roller filming is intensified through the degradation of the toner adhesion, and the contamination in a non-image region is caused through the reduction in toner electrification.

Developing Roller Comparative Example 2

It can be seen that due to the coating layer being formed by forming a urethane resin only using acryl polyol having a high glass transition temperature $T_g$ on the elastic layer formed of a silicon material having low hardness, a crack in a surface of the coating layer is caused due to a large hardness difference between the elastic layer and the coating layer, and the issue on durability is caused due to the acceleration of the toner filming by the crack.

Developing Roller Comparative Example 3

It can be seen that due to the coating layer being formed by forming a urethane resin only using caprolactone polyol having a glass low transition temperature $T_g$ on the elastic layer formed of a hydrin material having high hardness, a crack in a surface of the coating layer is caused due to a large hardness difference between the elastic layer and the coating layer, and the issue on durability is caused due to the acceleration of the toner filming by the crack. It can also be seen that the contamination in a non-image region is caused due to the degradation of the toner adhesion and reduction in toner electrification.

Developing Roller Comparative Example 4

It can be seen that due to the coating layer being formed by forming a urethane resin only using acryl polyol having a high glass transition temperature $T_g$ on the elastic layer formed of a hydrin material having high hardness, the toner stress is intensified due to increase in the surface hardness of the coating layer, and thus the developing roller filming and the issue on durability are caused.

TABLE 2

| Charging roller | | | | | | | | | |
|---|---|---|---|---|---|---|---|---|---|
| | | Example 1 | Example 2 | Example 3 | Example 4 | Comparative Example 1 | Comparative Example 2 | Comparative Example 3 | Comparative Example 4 |
| elastic layer | material | silicon | silicon | hydrin | hydrin | silicon | silicon | silicon | silicon |
| Coating layer | ε-caprolactone-modified hydroxy acrylate | 30 | 30 | 70 | 70 | 30 | 30 | 30 | 30 |
| | ε-caprolactone polyol | 70 | 70 | 30 | 30 | 70 | 70 | 70 | 70 |

TABLE 2-continued

| | | Charging roller | | | | | | | |
|---|---|---|---|---|---|---|---|---|---|
| | | Example 1 | Example 2 | Example 3 | Example 4 | Comparative Example 1 | Comparative Example 2 | Comparative Example 3 | Comparative Example 4 |
| | Hexamethylene diisocyanate (HDI) | 73 | 73 | 73 | 73 | 73 | 73 | 73 | 73 |
| | Dispersing agent methyl-oxirane polymer with oxirane, mono (diethyl-amino) alkyl ether | 2 | 11 | 2 | 11 | 0 | 1 | 12 | 15 |
| | MA-100 carbon black | 7 | 7 | 7 | 7 | 7 | 7 | 7 | 7 |
| | silica | 30 | 30 | 30 | 30 | 30 | 30 | 30 | 30 |
| Property value of charg-ing roller | Surface hardness (IRHD) | 40 | 40 | 55 | 55 | 40 | 40 | 40 | 40 |
| | Hardness of elastic layer(Asker A) | 38 | 38 | 50 | 50 | 38 | 38 | 38 | 38 |
| | Gloss | 5.0 | 5.1 | 5.0 | 5.0 | 5.1 | 5.1 | 5.1 | 5.1 |
| | Resistance (300 V) | 6.0E+05 | 6.0E+05 | 6.0E+05 | 6.0E+05 | 6.0E+05 | 6.0E+05 | 6.0E+05 | 6.0E+05 |
| | Roughness Rz | 4 | 4 | 4 | 4 | 4 | 4 | 4 | 4 |
| | Surface crack | ◎ | ◎ | ◎ | ◎ | ◎ | ◎ | ◎ | ◎ |
| Image quality | Image concentration | ◎ | ◎ | ◎ | ◎ | ◎ | ◎ | ◎ | ◎ |
| | Resistance change according to time | ○ | ◎ | ○ | ◎ | X | X | ◎ | ◎ |
| | Migration | ◎ | ○ | ◎ | ○ | ◎ | ◎ | X | X |
| | Contamination of non-image region due to charging failure | ○ | ◎ | ○ | ◎ | X | Δ | ◎ | ◎ |

◎: very good
○: good
Δ: acceptable
X: no good

The numerical values in Table 2 for the rows for "coating layer" indicate the respective weight part of each component relative to other listed components.

Charging Roller Comparative Example 1

It can be seen that the charging roller is deviated from the resistance region by the resistance change according to time, due to agglomeration and precipitation of the carbon black by the non-addition of a dispersing agent, and the contamination of a non-image region is caused due to charging failure.

Charging Roller Comparative Example 2

It can be seen that the charging roller is deviated from the resistance region by the resistance change according to time, due to agglomeration and precipitation of the carbon black by the lack of the amount of the dispersing agent in addition of a small amount (1 phr) of the dispersing agent, and the contamination of a non-image region is caused due to charging failure.

Charging Roller Comparative Example 3

It can be seen that the contamination of a non-image region is caused due to the migration in addition of an excessive amount (12 phr) of the dispersing agent in the high temperature and high humidity package evaluation.

Charging Roller Comparative Example 4

It can be seen that the contamination of a non-image region is caused due to the migration in addition of an excessive amount (15 phr) of the dispersing agent in the high temperature and high humidity package evaluation.

It can be seen from the above-described Examples and comparative examples that when only the acryl polyol is selected as the urethane resin for the roller coating layer, the toner electrification, the toner adhesion, and the like are good, but low temperature characteristics such as the intensification of the toner stress by stiffness in a low temperature are not good, and thus realization of long lifespan in the roller is difficult. When the hardness of the elastic layer is low, the crack in the coating layer is caused due to a large harness difference between the elastic layer and the coating layer, and thus application of the coating layer to the low hardness elastic layer is difficult.

When only the ε-caprolactone polyol is selected as the urethane resin for the roller coating layer, the low temperature characteristic is good, but the toner adhesion is not good and the toner electrification is problematic. Thus, in response to only the ε-caprolactone polyol being used, the contamination of a non-image region is caused and the roughness control is difficult. When the hardness of the elastic layer is high, the crack in the coating layer is caused due to a large hardness difference between the coating layer and the elastic layer, and thus application of the coating layer to the high hardness elastic layer is difficult.

In the roller according to an exemplary embodiment, the coating layer may be formed using a urethane resin in which a mixed material of stiff acryl polyol having high hardness and soft ε-caprolactone polyol having no acryl ingredient and having low hardness is cross-linked, and the acryl polyol and the ε-caprolactone polyol may be combined at a ratio of 90:10 to 10 to 90 and applied regardless of the hardness of the elastic layer. The demerits of the acryl polyol having high hardness and the demerits of the ε-caprolactone polyol having low hardness may be mutually supplemented, and thus crack occurrence may be alleviated and the low temperature characteristic, toner adhesion, and toner electrification may be good.

In the roller according to an exemplary embodiment, a conductive agent for giving conductivity may be added to the collating layer and a dispersing agent for preventing agglomeration and sedimentation of the conductive agent is added to the coating layer, and thus the precipitation and agglomeration of the conductive agent in a coating material lot or batch may be prevented. Accordingly, the conductive roller which ensures the resistance stability having a small resistance variation in the fabricated coating layer may be obtained.

The roller having the above-described effects may be applied to an image forming apparatus, and thus a printed image having high image quality and stable quality may be obtained.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A roller for an image forming apparatus comprising:

a shaft;

an elastic layer covering an outer circumference of the shaft; and a coating layer formed on the elastic layer, the coating layer including acryl polyol and ε-caprolactone polyol in a mixture cross-linked by isocyanate.

2. The roller as claimed in claim 1, wherein a weight ratio of the acryl polyol to the ε-caprolactone polyol included in the coating layer is 90:10 to 10:90.

3. The roller as claimed in claim 1, wherein the acryl polyol is ε-caprolactone-modified hydroxy acrylate.

4. The roller as claimed in claim 3, wherein the ε-caprolactone-modified hydroxy acrylate is a compound represented by:

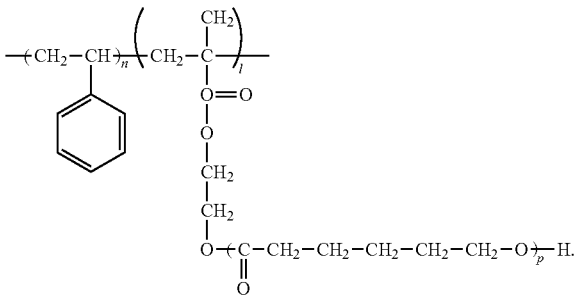

5. The roller as claimed in claim 1, wherein the ε-caprolactone polyol is selected from the group consisting of polycaprolactone diol, polycaprolactone triol, and polycaprolactone tetraol.

6. The roller as claimed in claim 1, wherein the coating layer further includes a conductive agent and a dispersing agent.

7. The roller as claimed in claim 6, wherein the conductive agent is carbon black, and the dispersing agent is methyloxirane polymer with oxirane, mono (diethylamino) alkyl ether.

8. The roller as claimed in claim 6, wherein the dispersing agent is included in the coating layer in 2 to 11 weight parts with respect to 100 total weight parts of the acryl polyol and the ε-caprolactone polyol.

9. The roller as claimed in claim 1, wherein the acryl polyol has a glass transition temperature ($T_g$) of 0° C. to 20° C., and the ε-caprolactone polyol has a glass transition temperature ($T_g$) of −40° C. or less.

10. The roller as claimed in claim 1, wherein the coating layer has a thickness of 0.5 μm to 50 μm.

11. The roller as claimed in claim 1, wherein the coating layer contains beads including an acryl-based resin, a polyamide-based resin, a polyolefin-based, a silicon-based resin, a phenol-based resin, a polyurethane-based resin, a styrene-based resin, benzoguanamine, a polyfluorovinylidene-based resin, silica, or metal oxide powder.

12. The roller as claimed in claim 1, wherein the elastic layer includes one or a combination of polyurethane, natural rubber, butyl rubber, nitrile rubber, polyisoprene rubber, polybutadiene rubber, silicon rubber, styrene-butadiene rubber, ethylene-propylenerubber, ethylene-propylene-diene rubber, chloroprene rubber, and acrylic rubber.

13. An image forming apparatus using the roller according to claim 1.

14. An image forming apparatus comprising:

a photoreceptor to carry an electrostatic latent image formed thereon;

a developing roller configured to supply a toner to the photoreceptor; and a charging roller configured to charge the photoreceptor, wherein at least one of the developing roller and the charging roller is the roller according to claim 1.

15. A roller for an image forming apparatus comprising:

a shaft;

an elastic layer covering an outer circumference of the shaft; and a coating layer formed on the elastic layer, the coating layer including acryl polyol mixed with and cross-linked to ε-caprolactone polyol.

16. The roller as claimed in claim 3, wherein the ε-caprolactone-modified hydroxy acrylate is hydroxyethyl methacrylate.

17. The roller as claimed in claim 3, wherein the ε-caprolactone-modified hydroxy acrylate is hydroxyethyl acrylate.

18. The roller as claimed in claim 15, wherein the acryl polyol is a compound represented by:

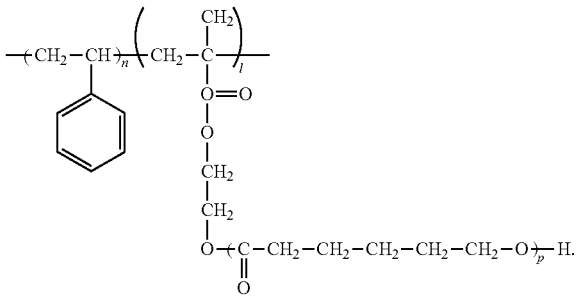

19. The roller as claimed in claim 15, wherein the acryl polyol is hydroxyethyl methacrylate.

20. The roller as claimed in claim 15, wherein the acryl polyol is hydroxyethyl acrylate.

* * * * *